US007473157B2

(12) United States Patent
Reinhardt et al.

(10) Patent No.: US 7,473,157 B2
(45) Date of Patent: Jan. 6, 2009

(54) PRACTICE SAMURAI SWORD

(75) Inventors: Julius Henry Reinhardt, Oxford, GA (US); Eddie Floyd, Spring City, TN (US)

(73) Assignee: United Cutlery Corporation, Thomasville, GA (US)

( * ) Notice: Subject to any disclaimer, the term of this patent is extended or adjusted under 35 U.S.C. 154(b) by 300 days.

(21) Appl. No.: 11/358,493

(22) Filed: Feb. 21, 2006

(65) Prior Publication Data

US 2007/0197128 A1 Aug. 23, 2007

(51) Int. Cl.
*A63H 33/30* (2006.01)
*A63H 33/00* (2006.01)

(52) U.S. Cl. ..... 446/473; 434/11; 463/47.2; 482/12

(58) Field of Classification Search ..... 446/473; 434/11; 463/47.2, 47.6, 47.7; 482/12, 83, 482/84, 109
See application file for complete search history.

(56) References Cited

U.S. PATENT DOCUMENTS 5,174,756 A * 12/1992 Taylor ..... 434/11
5,295,926 A 3/1994 Tanabe
5,324,227 A 6/1994 Yuh-Ching
5,598,596 A 2/1997 Jones et al.
5,630,998 A 5/1997 Parsons
6,036,602 A 3/2000 Abbott
6,497,619 B2 12/2002 Dowdy et al.
7,278,898 B2 * 10/2007 Kim et al. ..... 446/473

* cited by examiner

*Primary Examiner*—Kien T Nguyen
(74) *Attorney, Agent, or Firm*—Jones Day

(57) ABSTRACT

A practice sword simulating a Katana. The practice sword provides an affordable, safe practice weapon that correctly simulates the size, weight and curve of the Japanese sword with both simulated cutting and thrusting capabilities. The practice sword includes generally a handle, a handle guard, and a simulated blade. The blade is comprised of a plurality of flexible limbs. The limbs are interconnected at a proximal end, proximate the handle and handle guard. The distal end of each limb is limited to axial movement with respect to each other limb. The blade includes a plurality of flexible limbs. The proximal end of each flexible limb is fixed relative to each other proximate the handle guard. The distal end of each flexible limb is limited to axial movement with respect to each other flexible limb.

12 Claims, 8 Drawing Sheets

PRACTICE SAMURAI SWORD

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention pertains to the field of martial arts. More particularly, this invention is related to a practice Samurai sword for simulating combat with a safe weapon closely emulating the size, weight and shape of a Samurai sword.

2. Description of the Related Art

In the field of martial arts, it is well know that many forms of combat use weapons of one fashion or another. Many of the martial arts use swords in hand-to-hand combat. However, it is also well known that many of the martial arts are practiced as an art form and not as a means for actual combat.

In order to reduce the danger associated with authentic weaponry, it is well-known to use practice weaponry. For example, a Shinai is used to simulate a Japanese sword. A Shinai, from the verb "shinau" meaning "to bend" or "to be flexible", is a bamboo Kendo sword that allows a Kendoist to practice freely without fear of serious injury to his self or others. The modern Shinai is constructed of four staves of bamboo fitted together into a cylinder and held together by leather and a string.

The first Shinai were made of split bamboo and completely covered in a cloth or leather bag known as a Fukuro Shinai or bag Shinai. Shinai were of many different lengths and weights. Today, the Shinai is made from bamboo that is cut from the bottom of the culm, or stem, about four inches above ground. The stem is split vertically into six to eight pieces. The bamboo is then dried and four pieces are selected, straightened, and then planed and shaped into a Shinai. As will be understood, there are deliberate methods used to produce each Shinai.

In addition to the four bamboo slats, the Shinai includes a leather handgrip called the Tsuka-gawa covering the tsuka, or handle, a leather cup called the sakigawa on the tip, or kissaki, and a tsuba, or hand guard. The tsuba is fabricated from resin or leather and is held in place by a tsuba-dome, which is a rubber disk. The whole is kept together under tension by a string, called a tsuru, connecting the leather parts at each end, and by a leather binding, or Nakayui, around the Shinai marking out the Datotsubu (the valid strike area of the Shinai) or the Monouchi, which is the top part of the blade toward the tip, which is the most effective cutting area of the Shinai.

The Shinai allows full strength cuts to be made without the risk of injuring the training partner as would an authentic sword or a solid wooden dummy sword. The force of the blow is dissipated by the bamboo sections spreading out on contact. However, the force is often painful. A Shinai strike does not feel like a sword and a thrust can be dangerous, as there is no give in the blade.

In Kendo the solid wooden sword, or boken, is still used in the Kendo Kata, and more rarely in Waza, practice in order to gain a better understanding of how the technique works with a sword. However it is not used for free-sparring. The steel Katana, or alloy Iaito are used by high grades in Kata demonstrations and are the standard weapon used in Iaido.

Other devices have been developed to overcome these and similar problems associated with practice swords. Typical of the art are those devices disclosed in the following U.S. patents:

| U.S. Patent No. | Inventor(s) | Issue Date |
|---|---|---|
| 5,295,926 | T. Tanabe | Mar. 22, 1994 |
| 5,324,227 | C. Yuh-Ching | Jun. 28, 1994 |
| 5,598,596 | M. R. Jones et al. | Feb. 4, 1997 |
| 5,630,998 | K. L. Parsons | May 20, 1997 |
| 6,036,602 | D. G. Abbott | Mar. 14, 2000 |
| 6,497,619 | D. D. Dowdy et al. | Dec. 24, 2002 |

Of these patents, Tanabe ('926) discloses a soft sword. The '926 device includes a core rod which comprises a short flexible center core having a grip and a guard constructed in one body and a soft core mounted coaxially around said flexible center core. A bag is disposed on the core rod by engaging at both ends of the core rod. A grip tape is wrapped onto the grip and over the bag. The '926 device is configured such that neither participants nor spectators will be injured during a match, whether by a strike using the device or by a portion of the device becoming dislodged from the device and being flung through the air.

U.S. Pat. No. 5,324,227, issued to C. Yuh-Ching, discloses a toy hitting rod. The '227 device includes a main hitting rod made of resilient material and formed with a longitudinal hole at the center. Two aligned holes are formed at one end thereof. An inner hitting rod is fabricated from resilient material and inserted into the longitudinal hole of the main hitting rod. A spring is sleeved on one end of the inner hitting rod. A hand grip is fabricated from a hard material and defines a recess for grasping. The grip has a connecting rod having a through hole in alignment with the aligned holes of the main hitting rod. The connecting rod defines two protuberances engageable with the other end of the spring. The '227 device is configured for safe use as a "weapon" in hand-to-hand combat. Upon impact, the main hitting rod is deformed to reduce the impact. After impact, the resiliency of the main hitting rod causes the device to return to its original state.

Jones et al., in the '596 patent, disclose a club shaped device having a removable cover. The cover encloses a substantial portion of the club and is fastened thereto. In one embodiment, the '596 device is composed of a head and a handle both constructed from a resilient material, such as dense foam rubber. The handle has a hollow interior area which has an opening at its bottom. The edges of the removable covering are placed into the opening and a removable plug is inserted into the opening to steadfastly hold the edges of the cover against the inner wall of the handle. In one embodiment, the '596 device is used as a soft club novelty item without causing injury to items struck by the club.

In his '998 patent, Parsons discloses a mock training baton including a flexible rod covered by a cushioning material secured to the rod by a removable cover. The '998 device may include a protective resilient disk at the ends of the rod and a means for securing the baton to the belt of trainee. The diameter, configuration and material of the handle of the mock training baton are identical to those of the handle of the actual standard issue baton. The mock baton may include a resilient ring for securing the cover to the baton and a fixed collar for anchoring the resilient disk in place.

Abbot, in the '602 patent, discloses a sparring instrument which is described as allowing for safe, pain free, full contact training. The sparring instrument comprises a handle and a striking portion having a bushing armature mounted thereto. The bushing armature comprises a tip rod telescopically received within a plurality of telescopically mounted cylinders. The bushing armature is covered by a sheath extending beyond the tip rod. The sheath is covered by a soft, flexible material to its end. The sheath is made of a soft, resilient material whereby the sheath extends from the end of the soft, flexible material when the instrument is bent.

Finally, Dowdy et al., in their '619 patent, disclose A scoring system is disclosed which allows for safe, accurate scoring during simulated combat situations. The scoring system includes a simulated striking apparatus having a marking means to safely deliver an erasable marking agent when the striking apparatus contacts an opponent. The striking sections of the apparatus are buffered by a soft, resilient material to reduce the impact from a striking type blow.

BRIEF SUMMARY OF THE INVENTION

The present invention is a practice sword simulating a Katana. The practice sword provides an affordable, safe practice weapon that correctly simulates the size, weight and curve of the Japanese sword with both simulated cutting and thrusting capabilities. The practice sword includes generally a handle, a handle guard, and a simulated blade. The blade is comprised of a plurality of flexible limbs. The limbs are interconnected at a proximal end, proximate the handle and handle guard. The distal end of each limb is limited to axial movement with respect to each other limb.

In one embodiment, the blade is comprised of an upper limb and a lower limb. The upper limb defines an inverted substantially U-shaped configuration having a substantially flat top surface. The top surface being substantially flat provides stability of the blade in the lateral directions. The lower limb also defines a substantially U-shaped configuration having an arcuate bottom surface, which provides stability of the blade in the vertical directions and creates a less harmful and less painful impact zone.

At least one clamp is provided for maintaining the relative positions of the upper and lower limbs. A proximal end clamp is secured to the distal end of each of the upper and lower limbs proximate the handle guard. The proximal end clamp serves to secure the proximal end of each of the upper and lower limbs together. At least one medial clamps is positioned along the length of the blade. A distal end clamp is disposed at the distal end of the blade. In a shorter sword, a single medial clamp is provided. Each of the medial and distal end clamps defines a saddle portion configured to slidably receive the lower limb. Each of the medial clamps and the distal end clamp is configured to be secured to the upper limb, such that the lower limb is limited only to axial movement with respect to the upper limb.

The distal end clamp is further configured to retain the distal end of the lower limb, which is longer than the upper limb. When the upper and lower limbs are collectively deformed to bring the distal ends thereof into alignment, the distal end clamp is installed to maintain the curvature of the sword blade.

As the sword is thrust, the distal end of the sword is bent backward, causing the distal end of the lower limb to travel in a longitudinal direction backward within the distal end clamp. Because the medial and distal end clamps are secured only to the upper limb, the upper and lower limbs are permitted to bend without the sides of the sword buckling or breaking.

As the practice sword is used to strike, the floating lower limb and the distance between the medial and distal end clamps allow for substantial impact absorption. The upper and the lower limbs are in contact when resting in the preloaded state. Impact causes the upper and lower limbs to separate from each other, thus relieving some force.

The handle includes an extended portion of the proximal end of each of the upper and lower limbs. The handle guard defines an opening through which the blade is received prior to the securement of the proximal end, medial and distal end clamps. A handle insert is received between the extended portions of the respective proximal ends of the upper and lower limbs and secured thereto.

A further embodiment of the practice sword more closely resembling the Katana incorporates a blade having three flexible limbs, each fabricated preferably from bamboo. Each flexible limb is formed into a slight longitudinal curve. The curvature of the limbs allows the simulated blade to bend backward as a blow is struck, thus dissipating the force of the blow. Conversely, the longitudinal curvature limits forward bending of the blade. The force of a thrust with the sword is also dissipated by the same bending action.

The handle defines two extended portions. The handle guard defines an opening through which the extended portion is received. Upper and lower shoulders are defined by the handle for engaging the handle guard to limit movement of the handle guard toward the handle. The extended portions are spaced apart to closely receive the proximal end of the medial flexible limb. The uppermost flexible limb is disposed above the upper extended portion. Likewise, the lowermost flexible limb is disposed below the lower extended portion. The proximal end of each of the uppermost and lowermost limbs is disposed at the handle guard, thereby limiting movement of the handle guard away from the handle. The proximal end of each flexible limb is secured to the handle in a conventional manner.

An end spacer is disposed at the distal end of the blade. The spacer defines a distal end wall that provides a striking surface when thrusting the sword. Two spacing elements extend from the distal end wall. Each spacing element is configured to be received between the distal ends of an adjacent pair of flexible limbs. The distal end of the blade is wrapped with a distal end cover in order to maintain the position of the end spacer with respect to the uppermost flexible limb. The distal end of each of the intermediate and lowermost flexible limbs is allowed to float within the end spacer.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A practice sword simulating a Katana is disclosed. The practice sword of the present invention is illustrated at 10 in the figures. The practice sword, or practice sword 10, of the present invention provides an affordable, safe practice weapon that correctly simulates the size, weight and curve of the Japanese sword with both simulated cutting and thrusting capabilities.

Figure 1:
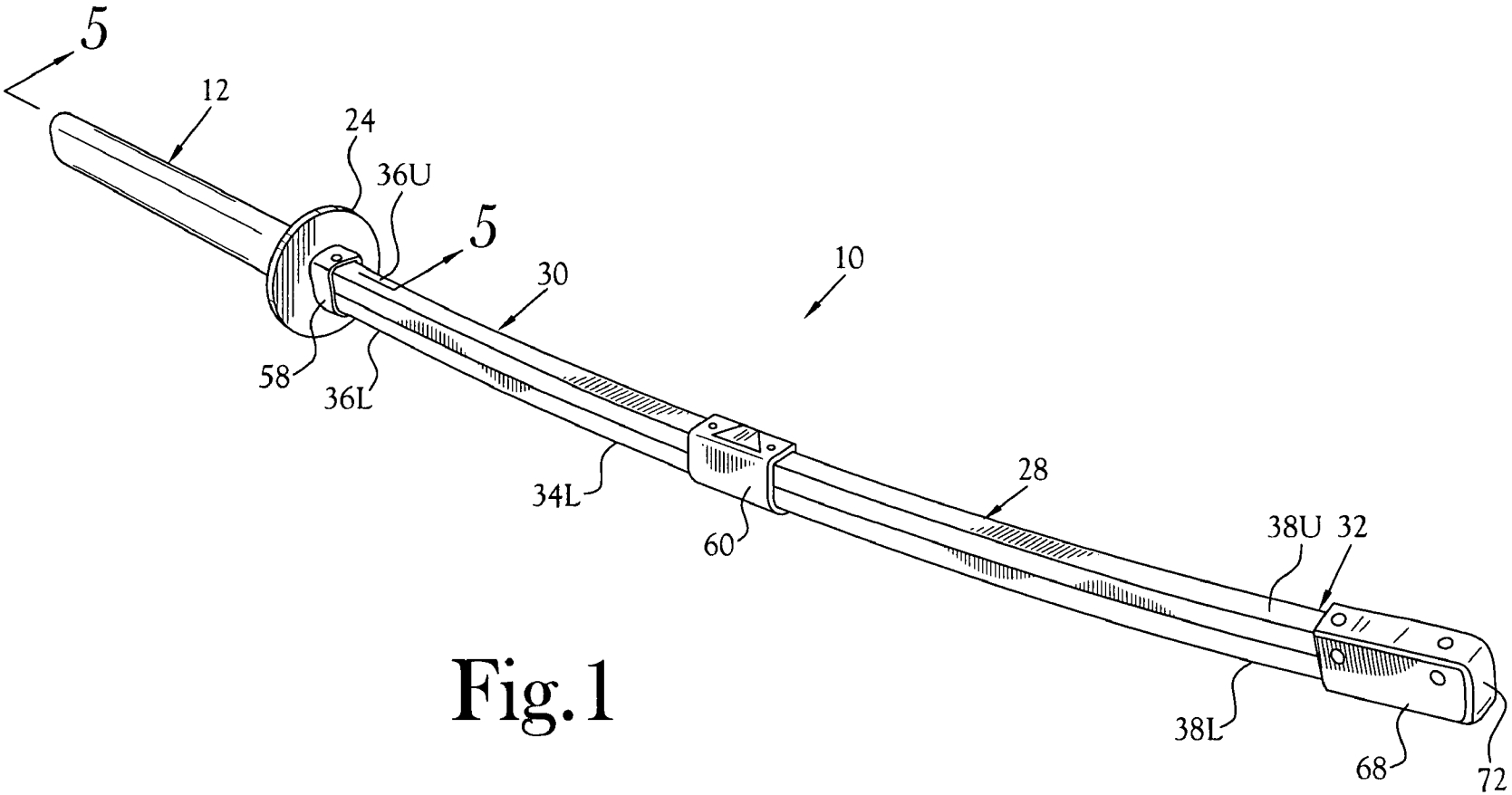
FIG. 1 is a perspective view of a preferred embodiment of a practice sword constructed in accordance with several features of the present invention.

FIG. 1 illustrates one embodiment of the practice sword 10 of the present invention. The practice sword includes generally a handle 12, a handle guard 24, and a simulated blade 28. The blade 28 is comprised of a plurality of flexible limbs 34. The limbs 34 are interconnected at a proximal end 36, proximate the handle 12 and handle guard 24. As discussed in greater detail below, the distal end 38 of each limb 34 is limited to axial movement with respect to each other limb 34. The blade 28 defines a taper from its proximal end 30 to its distal end 32. The taper is defined both in the lateral direction and in the vertical direction.

Figure 2:
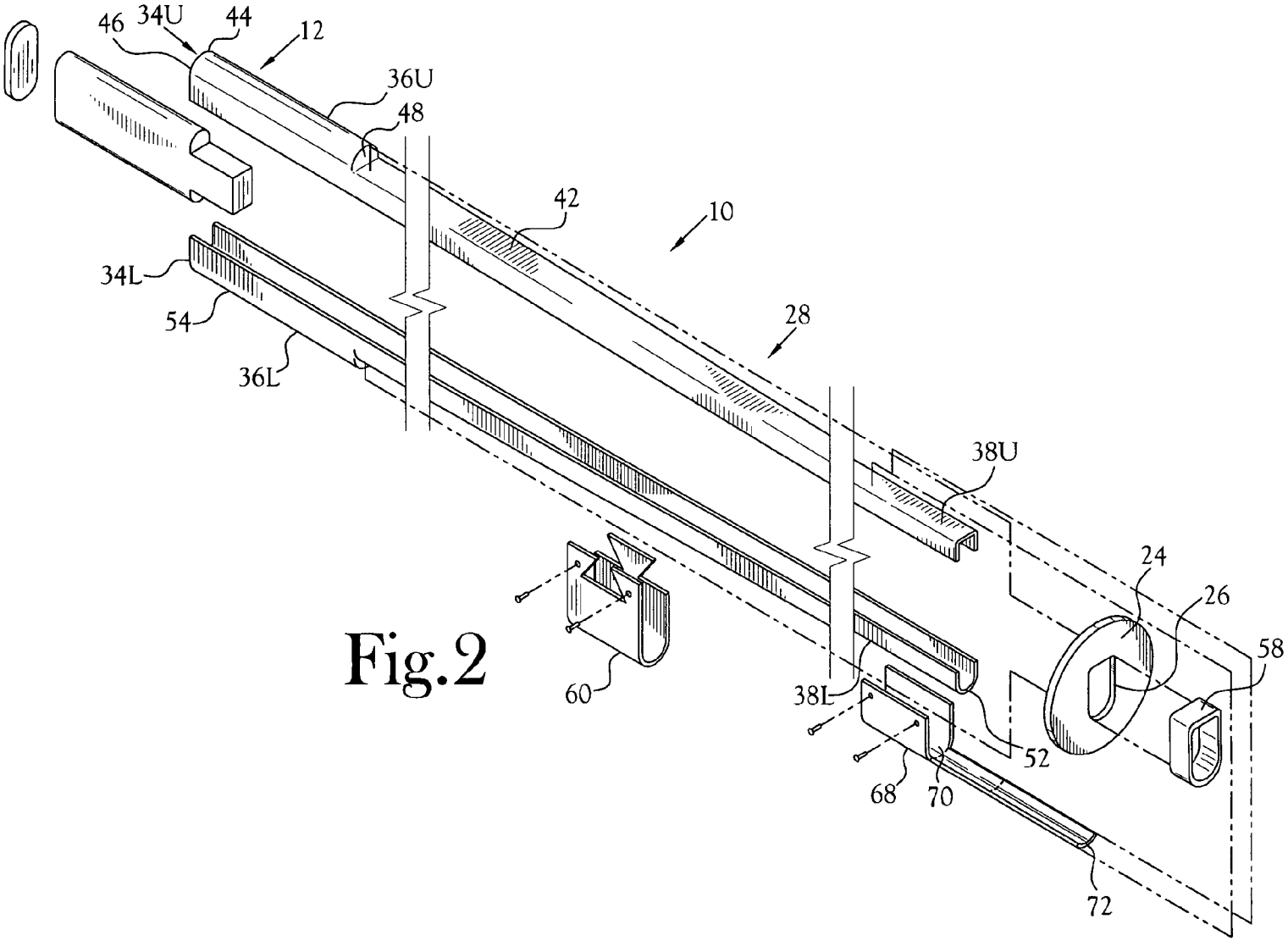
FIG. 2 is an exploded view, in perspective, of the practice sword of FIG. 1.

In the first illustrated embodiment, the blade 28 is comprised of two flexible limbs 34. More particularly, the blade includes an upper limb 34U and a lower limb 34L. As best illustrated in FIG. 2, which is an exploded view, in perspective, of the practice sword 10 of FIG. 1, the upper limb 34U of the illustrated embodiment defines an inverted substantially U-shaped configuration having a substantially flat top surface 42. The top surface 42 being substantially flat provides stability of the blade 28 in the lateral directions. Specifically, this limits bending of the blade 28 in either the left or right directions when the sword 10 is properly held.

The lower limb 34L also defines a substantially U-shaped configuration. However, the lower limb 34L defines an arcuate bottom surface 52. This configuration is beneficial in several ways. To wit, the arcuate configuration provides stability of the blade 28 in the vertical directions. Further, the arcuate configuration, which corresponds to the cutting edge of a blade, creates a less harmful, and therefore a less painful, impact zone. As discussed below, the lower limb 34L is longer than the upper limb 34U such that the upper and lower limbs 34U, 34L are deformed into an arcuate configuration to bring the respective distal ends 38U, 38L into alignment.

At least one clamp is provided for maintaining the relative positions of the upper and lower limbs 34U, 34L. In the illustrated embodiment, a proximal end clamp 58 is secured to the respective distal end 38U, 38L of each of the upper and lower limbs 34U, 34L proximate the handle guard 24. The proximal end clamp 58 serves to secure the proximal end 36U, 36L of each of the upper and lower limbs 34U, 34L together. Also illustrated is a medial clamp 60 positioned along the length of the blade 28, and a distal end clamp 68 disposed at the distal end 32 of the blade 28. It will be understood that the number and positioning of the medial clamps 60 may be varied within the scope of the present invention. For example, it may be desirable in some embodiments to include more medial clamps 60 in order to further increase the lateral stability of the blade 28, or to decrease the ability of the blade 28 to twist on impact.

Each of the medial clamps 60 and the distal end clamp 68 defines a saddle portion 62, 70, respectively, configured to slidably receive the lower limb 34L. Each medial clamp 60 defines a substantially U-shaped configuration, with the upper end 64 of each side extending away from the saddle portion 62 to engage the side portions of the upper limb 34U. Each medial clamp 60 is secured to the upper limb 34U in a conventional manner such that the lower limb 34L is substantially limited to longitudinal movement through the medial clamp 60. In the illustrated embodiment, conventional fasteners 66, such as rivets are used to accomplish such securement. However, it will be understood that other conventional fasteners 66 and means for fastening may be used.

The distal end clamp 68 is configured and secured to the sword 10 in similar fashion to the medial clamp 60, with the additional feature of an extended portion 72 configured to extend longitudinally from the saddle portion 70. The extended portion 72 is dimensioned to be deformed over the distal end 38U, 38L of each of the upper and lower limbs 34U, 34L, and secured to the top surface 42 of the upper limb 34U. While the distal end clamp 68 is configured to allow longitudinal movement of the lower limb 34L therein, the extended portion 72 limits such movement which would allow the lower limb 34L to extend beyond the distal end clamp 68. This extended portion 72 also provides a continuous striking surface, thereby eliminating the risk of injury due to the movement between the distal ends 38U, 38L of the upper and lower limbs 34U, 34L.

Further, as described in further detail below, the distal end clamp 68 serves to maintain the distal ends 38U, 38L of the upper and lower limbs 34U, 34L in alignment. As briefly disclosed above, the lower limb 34L is longer than the upper limb 34U such that when they are each deformed into an arcuate configuration, the respective distal ends 38U, 38L are aligned. When the upper and lower limbs 34U, 34L are so deformed, the distal end clamp 68 is then installed in order to maintain the curvature. Specifically, the distal end clamp extended portion 72 serves to limit the relative longitudinal movement of the lower limb 34L, preventing it from extending out of the distal end clamp 68, and thereby preventing the blade 28 from returning to its original, undeformed state.

FIGS. 3A-3D better illustrates the relative movement permitted between the upper and lower limbs 34U, 34L. While the movement is not easily detected within the medial clamps 60, it is more noticeable within the distal end clamp 68.

Accordingly, the distal end 38U, 38L of each of the upper and lower limbs 34U, 34L is shown in phantom to illustrate their approximate positions within the distal end clamp 68. Because the distal end clamp 68 is secured only to the distal end 38U of the upper limb 34U, the position of the upper limb distal end 38U within the distal end clamp 68 is the same in each figure.

Figures 3A, 3B, 3C, 3D:
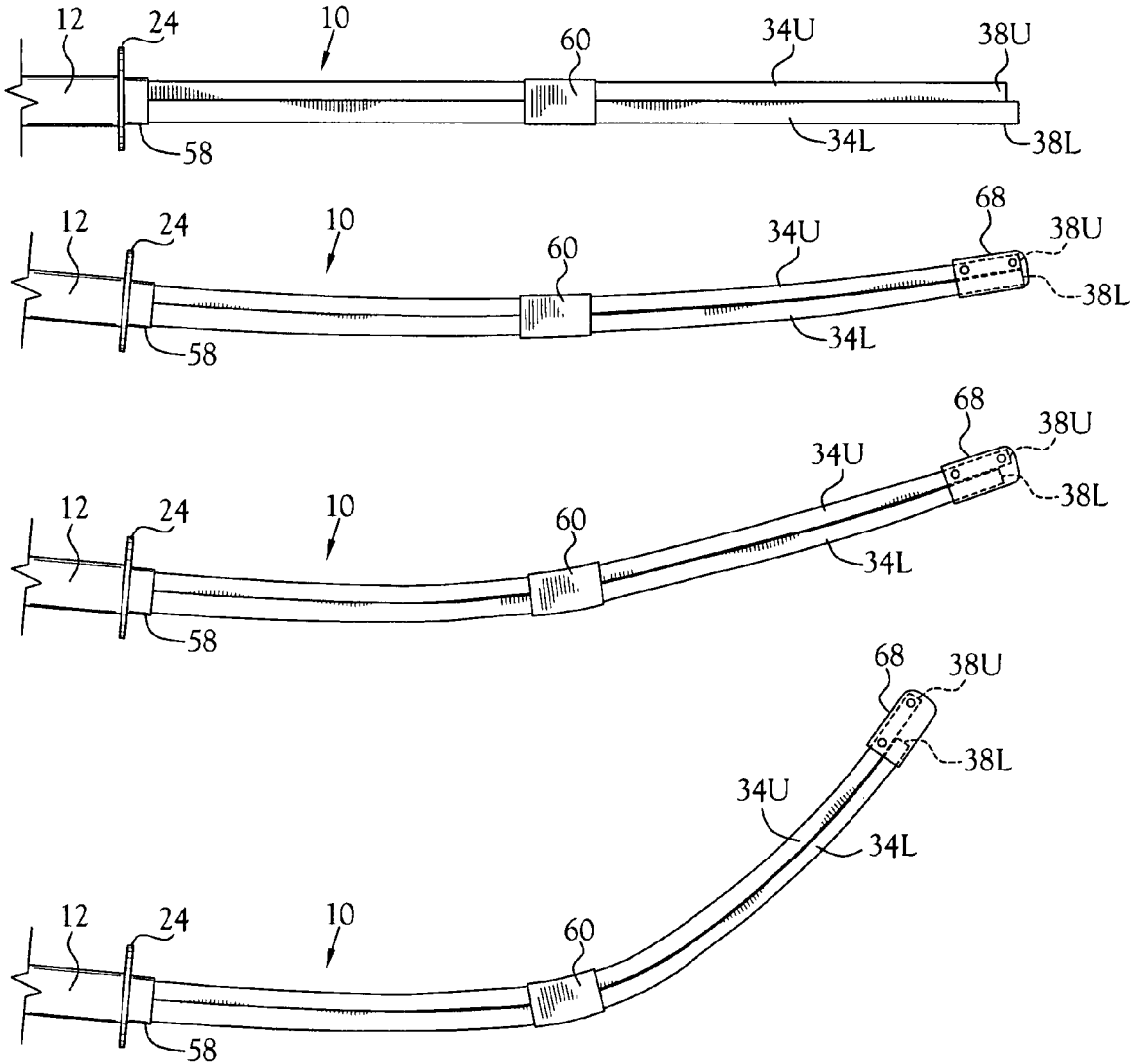
FIG. 3A is a side elevation view of the distal end of the blade, prior to the securement of the distal end clamp, wherein the lower limb is illustrated as defining a longer length than the upper limb.
FIG. 3B is a side elevation of the distal end of the blade after installation of the distal end clamp, wherein the blade is deformed into a curved configuration such that the distal ends of each of the upper and lower limbs are aligned.
FIG. 3C is a side elevation of the distal end of the blade illustrating the relative positions of the distal ends of the upper and lower limbs as the practice sword is thrust.
FIG. 3D is a side elevation of the distal end of the blade illustrating the further relative positions of the distal ends of the upper and lower limbs as the practice sword is thrust further.

FIG. 3A illustrates the sword 10 of the present invention prior to the securement of the distal end clamp 68. In this figure, it is more clearly illustrated that the lower limb 34L is longer than the upper limb 34U. As described above, when the upper and lower limbs 34U, 34L are collectively deformed into an arcuate configuration, the distal ends 38U, 38L of the upper and lower limbs 34U, 34L are brought into alignment. At this point, as illustrated in FIG. 3B, the distal end clamp 68 is secured, and the arcuate configuration is maintained.

FIGS. 3C and 3D illustrate the relative positions of the distal end 38U, 38L of each of the upper and lower limbs 34U, 34L as the sword 10 is thrust. As the result of this motion, the distal end 32 of the sword blade 28 is bent backward, causing the distal end 38L of the lower limb 34L to travel in a longitudinal direction backward within the distal end clamp 68. Because the medial and distal end clamps 60, 68 are secured only to the upper limb 34U, the upper and lower limbs 34U, 34L are permitted to bend without the sides of the sword 10 buckling or breaking.

Figure 4:
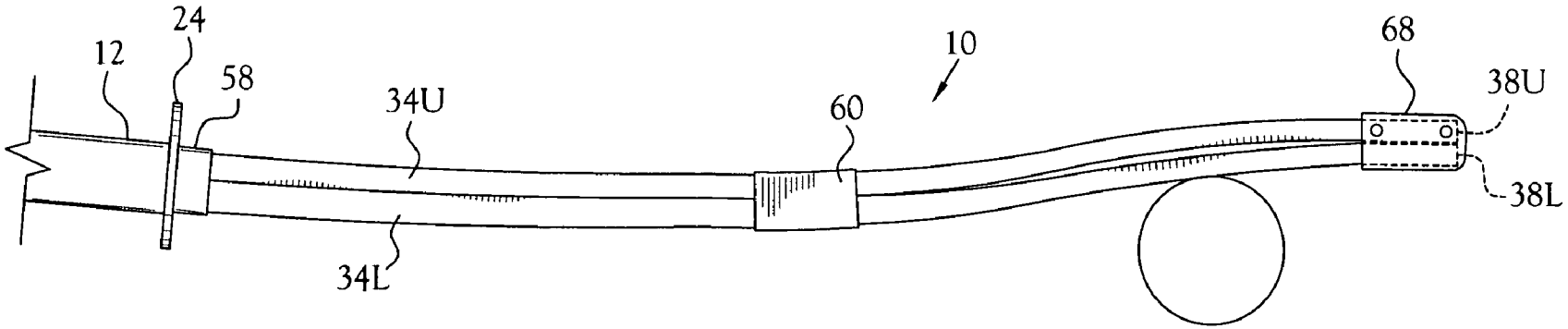
FIG. 4 illustrates the deformation of the blade during an impact, wherein the blade is deformed to define an S-shaped configuration.

FIG. 4 illustrates the deformation of the blade 10 during an impact. The floating lower limb 34L and the distance between the medial and distal end clamps 60, 68 allows for substantial impact absorption. The upper and the lower limbs 34U, 34L are in contact when resting in the preloaded state (FIG. 3B). Impact causes the upper and lower limbs 34U, 34L to separate from each other, thus relieving some force. In tests with both limbs 34U, 34L connected as one continuous tapering tube, the result was a substantial impact. However, in the illustrated embodiment wherein the upper and lower limbs 34U, 34L are fixed at their respective proximal ends 36U, 36L, the impact is reduced. This is a result of the upper and lower limbs 34U, 34L being allowed to rebound during duress or impact.

Figure 5:
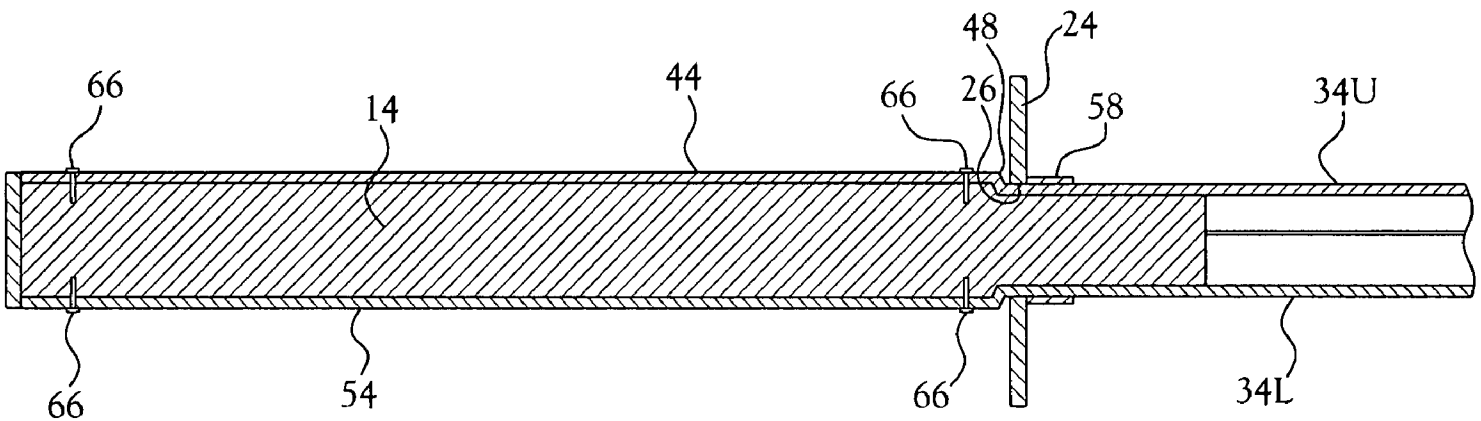
FIG. 5 is a side elevation view, in section taken along 5-5 of FIG. 1, of the handle of the practice sword of the present invention.

As illustrated in FIG. 5, the handle 12 of the illustrated embodiment includes a respective extended portion 44, 54 of the proximal end 36U, 36L of each of the upper and lower limbs 34U, 34L. The handle guard 24, or tsuba, defines an opening 26 through which the blade 28 is received prior to the securement of the proximal end, medial and distal end clamps 58, 60, 68. (See FIG. 2.) A handle insert 14 is received between the extended portions 44, 54 of the respective proximal ends 36U, 36L of the upper and lower limbs 34U, 34L and secured thereto. Securement of the handle insert 14 is accomplished via conventional means such as the illustrated fasteners 66. The handle insert 14 serves to give integrity to the handle 12. The securement of the handle insert 14 to the upper and lower limbs 34U, 34L also prevents movement "walking" of the upper and lower limbs 34U, 34L.

The extended portion 44 of the upper limb 34U defines an arcuate top surface 46. A transition 48 is thus defined between the arcuate surface 46 and the flat surface 42 on the blade portion of the upper limb 34U. The transition 48 serves as a limit for the handle guard 24.

Figure 6:
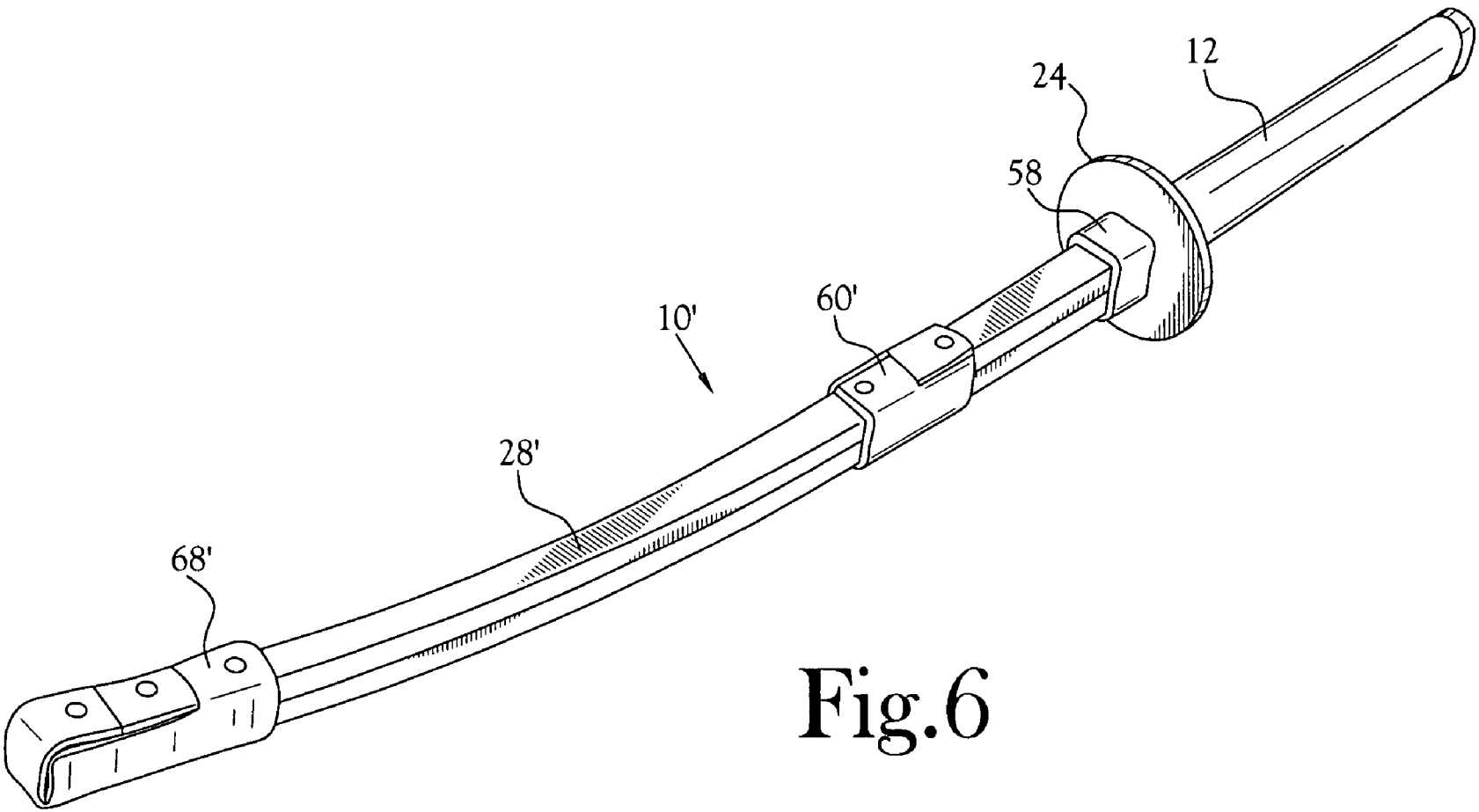
FIG. 6 is a perspective view of an alternate embodiment of a practice sword constructed in accordance with several features of the present invention.

FIG. 6 illustrates an alternate embodiment of the practice sword 10'. In this embodiment, the blade 28' defines a shorter length as compared to the previously described sword 10.

A further alternate embodiment of the practice sword is illustrated at 10" in FIGS. 7-10. In this embodiment, the practice sword 10" more closely resembles the Katana discussed above. However, in the practice sword 10" of the present invention, features as described above in the previous embodiments are incorporated therein in order to achieve a more realistic practice fight with less risk of injury. The practice sword 10" of the present invention is useful in full contact, full force matches.

The practice sword 10" includes generally a handle 12", a handle guard 24", and a simulated blade 28". The blade 28" is comprised of a plurality of flexible limbs 34". The limbs 34" are interconnected at a proximal end 36", proximate the handle 12" and handle guard 24". As discussed in greater detail below, the distal end 38" of each limb 34" is limited to axial movement with respect to each other limb 34". In the preferred embodiment, each flexible limb 34" is fabricated from bamboo. However, it will be understood that other materials may be used within the spirit of the present invention.

Illustrated are three flexible limbs 34". Each flexible limb 34" is formed into a slight longitudinal curve. The curvature of the limbs 34" allows the simulated blade 28" to bend backward as a blow is struck, thus dissipating the force of the blow. Conversely, the longitudinal curvature limits forward bending of the blade 28". The force of a thrust with the sword 10" is also dissipated by the same bending action.

Figures 7, 8:
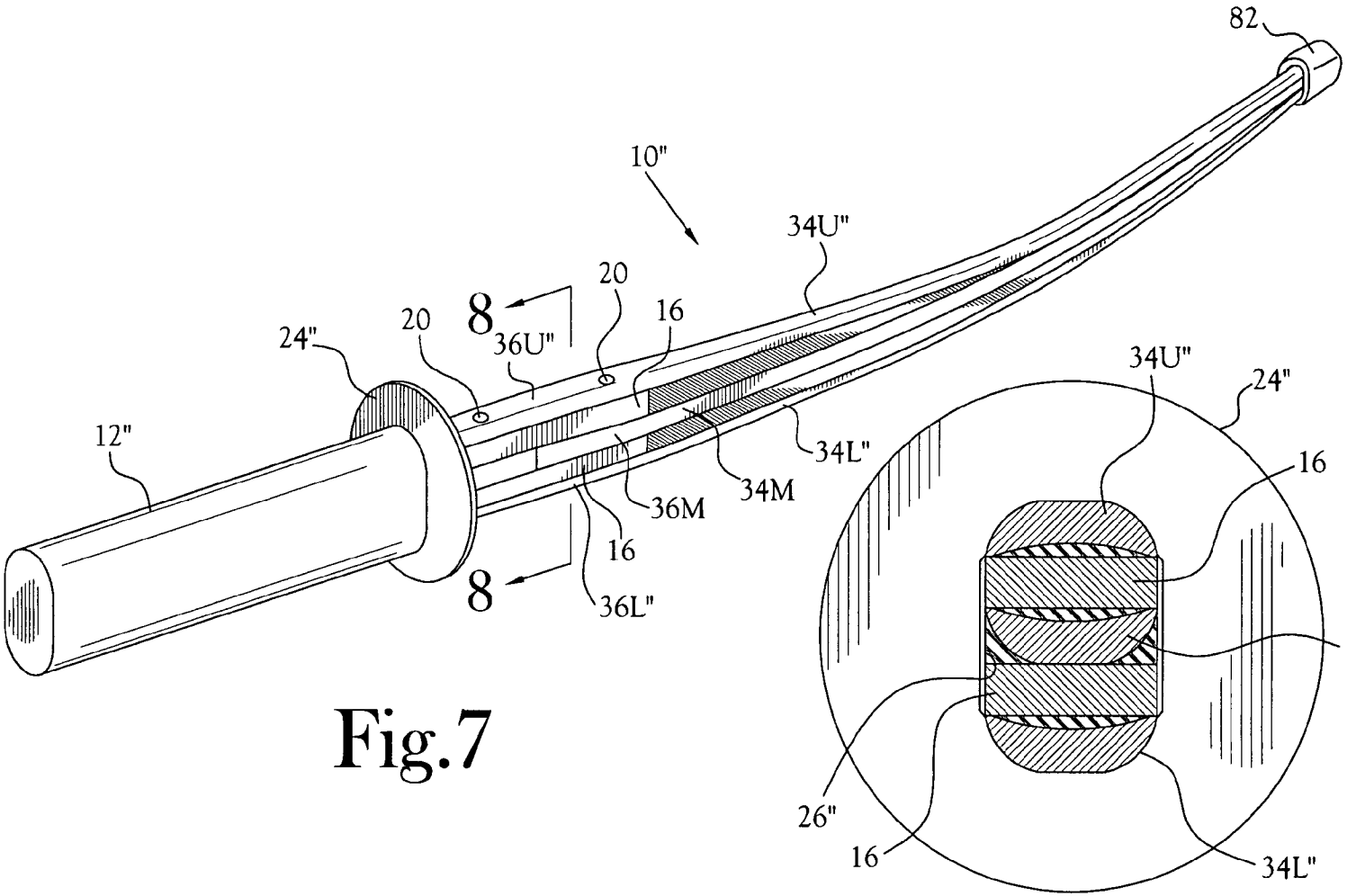
FIG. 7 is a perspective view of a further alternate embodiment of a practice sword constructed in accordance with several features of the present invention.
FIG. 8 is an end view, in section taken along 8-8 of FIG. 7, of the practice sword.

As best illustrated in FIG. 8, the cross section of each limb 34" defines a curvature as a result of the natural curvature of a bamboo stalk. Where a material other than bamboo is used, other cross-sectional configurations may be incorporated as well. However, in the illustrated embodiment, the lateral curvature of each limb 34" limits lateral bending of the sword 10" in either direction. Thus, the sword 10" is substantially limited to bending only in one direction.

In the illustrated embodiment, three flexible limbs 34" are incorporated. However, it will be understood that more or fewer may be used in various applications. To this extent, it will also be understood that each flexible limb 34" is not required to extend to the distal end 32" of the blade 28".

Figure 9:
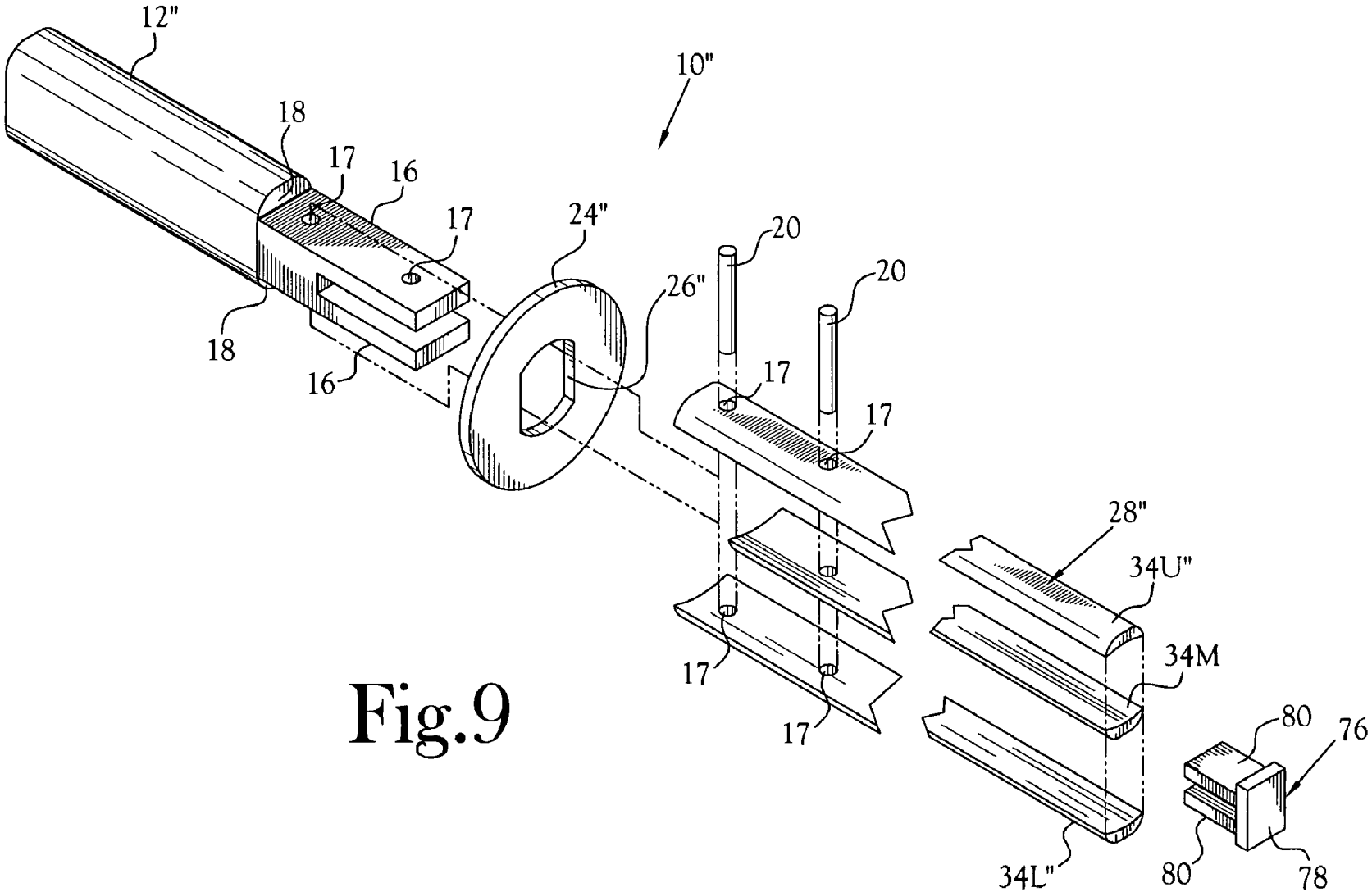
FIG. 9 is an exploded view, in perspective, of the practice sword of FIG. 7.

FIG. 9 illustrates an exploded view of the practice sword 10". This illustration more clearly shows the construction of the handle 12" and blade 28" of this embodiment. The handle 12" defines at least one extended portion 16. The handle guard 24" defines an opening 26 through which the extended portion 16 is received. Upper and lower shoulders 18 are defined by the handle 12" for engaging the handle guard 24" to limit movement of the handle guard 24" toward the handle 12". In the illustrated embodiment, two extended portions 16 are defined by the handle 12" and received through the handle guard opening 26". The extended portions 16 are spaced apart to closely receive the proximal end 36M of the medial flexible limb 34M. The uppermost flexible limb 34U" is disposed above the upper extended portion 16. Likewise, the lowermost flexible limb 34L" is disposed below the lower extended portion 16. The proximal end 36U", 36L" of each of the uppermost and lowermost limbs 34U", 34L" is disposed at the handle guard 24", thereby limiting movement of the handle guard away from the handle. As a result, the handle guard 24" is substantially prevented from movement after the sword 10" is assembled. The handle 12" of the preferred embodiment is provided with a conventional grip.

The proximal end 36" of each flexible limb 34" is secured to the handle 12" in a conventional manner. In the illustrated embodiment, two dowels 20 are closely received and glued into place within cooperating openings 17, 37 defined in the handle extended portions 16 and in the proximal end 36" of each of the limbs 34". In the preferred embodiment, the spaces defined between the handle extended portions 16 and the proximal ends 36" of the limbs 34" (see FIG. 8) are filled with an epoxy to strengthen the integrity of the sword 10".

Figure 10A:
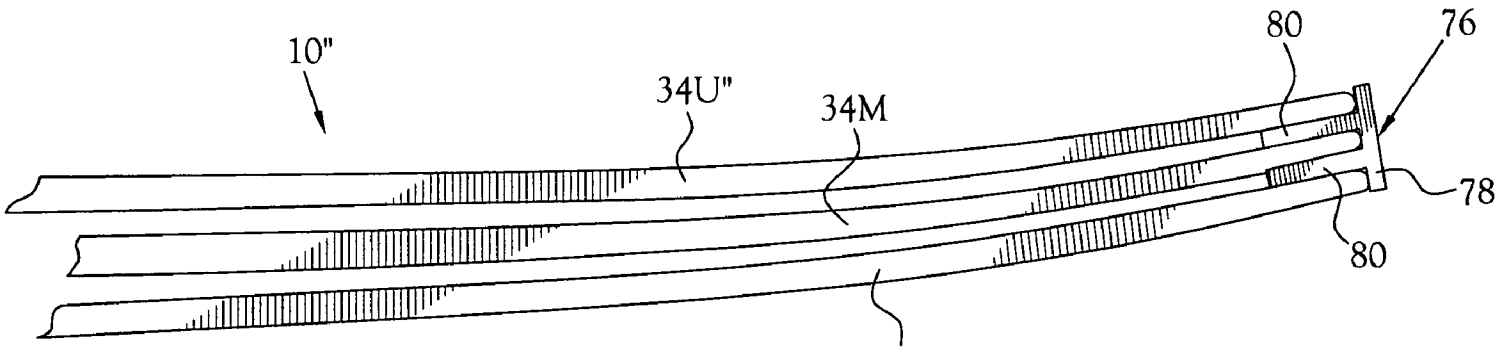
FIG. 10A is a side elevation of the distal end of the blade after installation of the end spacer, wherein the blade is deformed into a curved configuration such that the distal ends of each of the upper and lower limbs are aligned.

As illustrated in FIG. 10A, an end spacer 76 is disposed at the distal end 32" of the blade 28". The spacer 76 in the illustrated embodiment defines a distal end wall 78 that provides a striking surface when thrusting the sword 10". At least one spacing element 80 extends from the distal end wall 78. Each spacing element 80 is configured to be received between the distal ends 38" of an adjacent pair of flexible limbs 34". In the illustrated embodiment, two spacing elements 80 are provided. The distal end 32" of the blade 28" is wrapped with a distal end cover 82 in order to maintain the position of the end spacer 76 with respect to the uppermost flexible limb 34U". To this extent, the distal end cover 82 is secured to the distal end 38" of the uppermost flexible limb 34U".

Figure 10B:
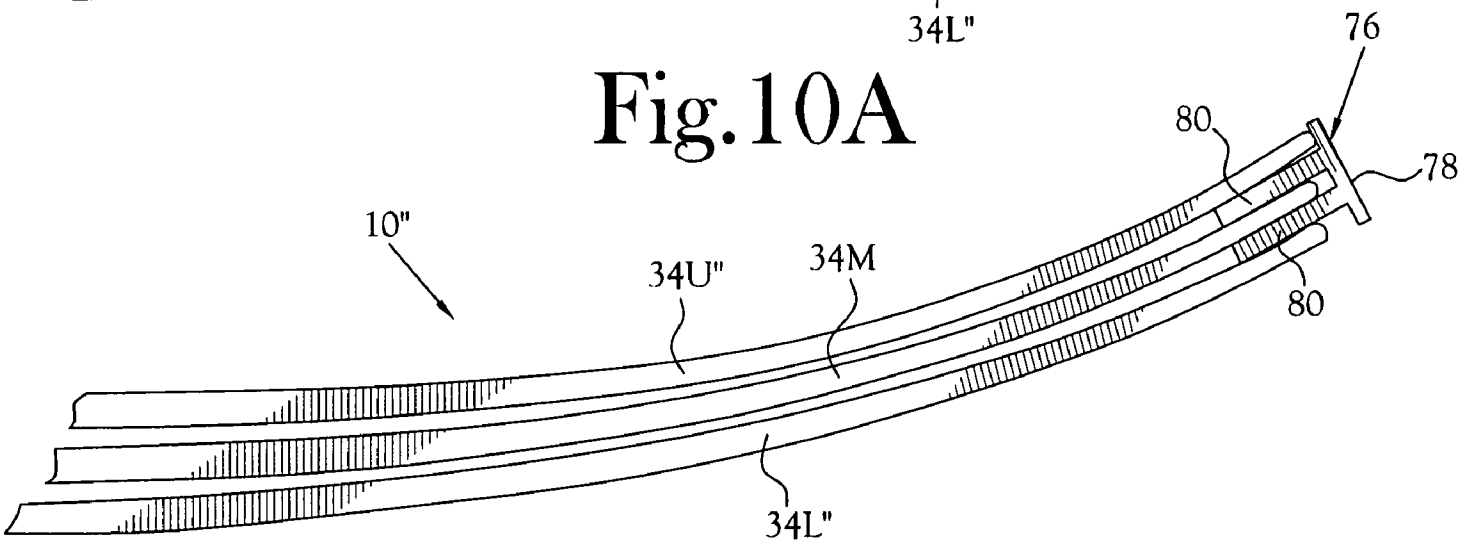
FIG. 10B is a side elevation of the distal end of the blade illustrating the relative positions of the distal ends of the upper and lower limbs as the practice sword is thrust.

The distal end 38M, 38L" of each of the medial and lowermost flexible limbs 34M, 34L" is allowed to float within the end spacer 76. This is illustrated in FIG. 10B, which illustrates the blade 28" being flexed backward when either a blow or thrust is struck.

Due to the spacing at the proximal ends 36" of the limbs 34" and the distal ends 38" of the limbs 34", the sword 10" simulates the sound of a Katana when either a blow or thrust is struck.

In order to simulate the weight of a real sword, weights (not illustrated) may be added to the sword 10" of the present invention, on either side of the proximal end 30" of the blade 28". This does not increase the force of the blow to any real degree, as the weight is merely forward of the hand, and there is no increase in mass in the striking area.

From the foregoing description, it will be recognized by those skilled in the art that several embodiments of a practice sword simulating a Katana have been provided. The practice sword of the present invention provides an affordable, safe practice weapon that correctly simulates the size, weight and curve of the Japanese sword with both simulated cutting and thrusting capabilities.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, we claim:

1. A practice sword for simulating a Katana, said practice sword comprising:

a handle;

a handle guard; and a blade defining a proximal end and a distal end, said blade including an upper limb and a lower limb, wherein each of said limbs defines a proximal end and a distal end, said proximal end of each flexible limb being secured to said practice sword proximate said handle guard, said lower limb being arcuate in nature and being in slidable communication with said upper limb; and an end clamp defining an interior for receiving said distal ends of said upper and lower limb wherein said lower limb is free to move from a first position to a second position within said interior which is retracted from said first position.

2. The practice sword of claim 1 wherein said blade defines a taper from said proximal end of said blade to said distal end of said blade, said taper being defined in at least one of a lateral direction and a vertical direction.

3. The practice sword of claim 1 further comprising at least one retainer for maintaining a relative position between said plurality of flexible limbs.

4. The practice sword of claim 1 wherein said upper limb defines a first length, and wherein said lower limb defines a second length, said second length being longer than said first length, said upper limb and said lower limb being deformed to define an arcuate configuration such that said upper limb distal end and said lower limb distal end are brought into alignment, said at least one retainer including a distal end retainer carried at said distal end of said blade for maintaining said arcuate configuration of said blade.

5. The practice sword of claim 1 wherein said at least one retainer includes a proximal end retainer secured to said proximal end of said upper limb and said proximal end of said lower limb.

6. The practice sword of claim 1 wherein said at least one retainer includes at least one medial retainer secured to one of said upper limb and said lower between said blade proximal end and said blade distal end.

7. The practice sword of claim 6 wherein each of said at least one medial retainer defines a saddle portion configured to slidably receive said lower limb, said saddle portion defining opposing sides configured to engage and be secured to said upper limb.

8. The practice sword of claim 1 wherein said proximal end of said upper limb defines an extended portion, wherein said proximal end of said lower limb defines an extended portion, and wherein said handle guard defines a central opening, said upper limb proximal end extended portion and said lower limb proximal end extended portion cooperating to define said handle, said handle being received through said handle guard central opening.

9. The practice sword of claim 8 further comprising a handle insert configured to be received within said handle and secured to each of said upper limb and said lower limb, said handle insert being provided to prevent relative movement between said upper limb proximal end extended portion and said lower limb proximal end extended portion.

10. A practice sword for simulating a Katana, said practice sword comprising:

a handle;

a handle guard;

a blade defining a proximal end and a distal end, said blade including a plurality of flexible limbs, wherein each of said plurality of flexible limbs defines a proximal end and a distal end, said proximal end of each flexible limb being secured to said practice sword proximate said handle guard, and said distal end of each of said plurality of flexible limbs being limited to axial movement with respect to each other of said plurality of flexible limbs;

said flexible limbs including an upper limb, said upper limb defining an inverted substantially U-shaped configuration having a substantially flat top surface; and a lower limb, said lower limb defining a substantially U-shaped configuration having an arcuate bottom surface.

11. A practice sword for simulating a Katana, said practice sword comprising:

a handle;

a handle guard;

a blade defining a proximal end and a distal end, said blade defining a taper from said proximal end of said blade to said distal end of said blade, said taper being defined in at least one of a lateral direction and a vertical direction, said blade including:

(i) an upper limb defining a first length and having a proximal end and a distal end, said upper limb defining an inverted substantially U-shaped configuration having a substantially flat top surface, said proximal end of said upper limb being secured to said practice sword proximate said handle guard; and (ii) a lower limb defining a second length and having a proximal end and a distal end, said lower limb defining a substantially U-shaped configuration having an arcuate bottom surface, said proximal end of said lower limb being secured to said practice sword proximate said handle guard, said distal end of said lower limb being limited to axial movement with respect to said distal end of said upper limb, said second length being longer than said first length, said upper limb and said lower limb being deformed to define an arcuate configuration such that said upper limb distal end and said lower limb distal end are brought into alignment;

a proximal end retainer secured to said proximal end of said upper limb and said proximal end of said lower limb;

at least one medial retainer secured to one of said upper limb and said lower between said blade proximal end and said blade distal end, each of said at least one medial retainer defining a saddle portion configured to slidably receive said lower limb, said saddle portion defining opposing sides configured to engage and be secured to said upper limb; and a distal end retainer carried at said distal end of said blade for maintaining said arcuate configuration of said blade.

12. The practice sword of claim 11 wherein said proximal end of said upper limb defines an extended portion, wherein said proximal end of said lower limb defines an extended portion, and wherein said handle guard defines a central opening, said upper limb proximal end extended portion and said lower limb proximal end extended portion cooperating to define said handle, said handle being received through said handle guard central opening.

* * * * *